US007436371B1

(12) United States Patent
Paulsen

(10) Patent No.: US 7,436,371 B1
(45) Date of Patent: Oct. 14, 2008

(54) WAVEGUIDE CRESCENT SLOT ARRAY FOR LOW-LOSS, LOW-PROFILE DUAL-POLARIZATION ANTENNA

(75) Inventor: Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 319 days.

(21) Appl. No.: 11/343,779

(22) Filed: Jan. 31, 2006

(51) Int. Cl.
*H01Q 13/10* (2006.01)

(52) U.S. Cl. ..... 343/771; 343/770

(58) Field of Classification Search ..... 343/767, 343/770, 771
See application file for complete search history.

(56) References Cited

U.S. PATENT DOCUMENTS

| | | | | |
|---|---|---|---|---|
| 3,701,162 | A * | 10/1972 | Seaton | 343/771 |
| 4,825,219 | A * | 4/1989 | Ajioka | 343/771 |
| 5,119,107 | A | 6/1992 | Wildey et al. | 343/770 |
| 6,304,228 | B1 | 10/2001 | Smith et al. | 343/771 |
| 6,476,772 | B1 | 11/2002 | Smith et al. | 343/771 |
| 6,977,621 | B2 * | 12/2005 | Kelly et al. | 343/771 |
| 7,061,444 | B2 * | 6/2006 | Pintos et al. | 343/771 |
| 7,202,832 | B2 * | 4/2007 | Wang | 343/771 |
| 2002/0149531 | A1 | 10/2002 | Smith et al. | 343/776 |
| 2003/0034930 | A1 | 2/2003 | Chen | 343/786 |
| 2004/0155829 | A1 * | 8/2004 | Ishii et al. | 343/770 |
| 2005/0146477 | A1 | 7/2005 | Kelly et al. | 343/771 |
| 2006/0132372 | A1 * | 6/2006 | Jung et al. | 343/766 |

* cited by examiner

*Primary Examiner*—Tho G Phan
(74) *Attorney, Agent, or Firm*—Nathan O. Jensen

(57) ABSTRACT

A low-loss, low-profile dual-polarization slotted waveguide antenna includes one or more waveguides having a characteristic wavelength. Radiation apertures comprised of a waveguide slot pairs are formed in each or the waveguides of the antenna. Each waveguide slot pair includes a first waveguide slot and a second waveguide slot which are configured for inducing a circularly polarized (CP) radiated field in the waveguide. The waveguide slots of each waveguide slot pair may be generally crescent-shaped and spaced a distance of at least approximately one-fourth of the characteristic wavelength from each other. The waveguide slots may further be positioned for allowing the antenna to receive and/or radiate both left-hand and right-hand circularly polarized fields (LHCP and RHCP) and for providing control of the sense of a circularly polarized (CP) field radiated by the antenna by changing the direction of incidence of an electromagnetic source wave propagated in the waveguide.

6 Claims, 8 Drawing Sheets

WAVEGUIDE CRESCENT SLOT ARRAY FOR LOW-LOSS, LOW-PROFILE DUAL-POLARIZATION ANTENNA

FIELD OF THE INVENTION

The present invention relates generally to the field of low-loss, low-profile dual-polarization slotted waveguide antennas of the type employed in Ku Band Satellite Communication (SatCom) Systems, or the like, and more particularly to a low-loss, low-profile dual-polarization slotted waveguide antenna having a crescent slot array for receiving and/or radiating a circularly polarized (CP) field.

BACKGROUND OF THE INVENTION

Antenna systems used in commercial Ku Band Satellite Communication (SatCom) systems, such as Direct Broadcast Satellite (DBS) systems, and the like, must have a low profile and high radiation efficiency due to the "figure of merit" or system G/T (i.e., the ratio of the system gain ("G") to the system noise temperature ("T")) requirements. Moreover, antenna aperture size is directly related to radome swept volume constraints. A low profile antenna allows a maximum antenna aperture size for a given radome swept volume, maximizing the system gain ("G") of the figure of merit or system G/T. High radiation efficiency further maximizes the gain ("G") of the system G/T. In Ku Band SatCom antenna applications such as, for example, aircraft horizontal stabilizer ("tail") mount antenna systems, optimizing the gain ("G") for a limited sized antenna is critical so that an appropriate system G/T value may be realized.

Commercial Ku Band Satellite Communication (SatCom) systems employ satellites that transmit and receive signals in a rotating corkscrew-like pattern. This mode of transmission, referred to as circular polarization allows the antenna to rotate to an arbitrary angle without being placed in a cross-polarized state. In this way, circular polarization reduces or eliminates the possibility of polarization miss-match, which can cause a reduction in the data rate. Waveguide antennas capable of radiating circularly polarized fields typically employ a rectangular waveguide having radiation apertures consisting of pairs of slots cut in the broad wall of the waveguide. These slots are positioned at 90 degrees to each other so that they cross at their centers to form an X-shaped opening in the waveguide which functions as a circularly polarized radiating element. However, such radiation apertures do not account for the intrinsic shape of the internal H-field within the fundamental $TE_{10}$ rectangular waveguide mode limiting the efficiency of the waveguide antenna.

Accordingly, it would be desirable to provide an improved low-profile, low-loss dual polarization waveguide antenna having an array of waveguide slot pairs that are configured for receiving and/or radiating a circularly polarized (CP) field, and which account for the intrinsic shape of the internal H-field within the fundamental $TE_{10}$ rectangular waveguide mode. It is further desirable that the slots of the waveguide slot pairs be arranged to provide control over the sense of the circularly polarized (CP) radiated field, and for allowing the antenna to receive both left-hand and right-hand circularly polarized fields (LHCP and RHCP).

SUMMARY OF THE INVENTION

Accordingly, the present invention is directed to a low-loss (high-efficiency), low-profile dual-polarization slotted waveguide antenna. In exemplary embodiments, the antenna includes one or more waveguides having a characteristic wavelength. Radiation apertures comprised of a waveguide slot pair are formed in each of the waveguides of the antenna. The waveguide slot pairs include a first waveguide slot and a second waveguide slot which are configured for receiving and/or radiating a circularly polarized (CP) field. In specific embodiments, the slots of the waveguide slot pair are generally crescent-shaped and spaced a distance of at least approximately one-fourth of the characteristic wavelength from each other. The waveguide slots may further be positioned for allowing the antenna to receive and/or radiate both left-hand and right-hand circularly polarized fields (LHCP and RHCP) and for providing control of the sense of a circularly polarized (CP) field radiated by the antenna by changing the direction of incidence of an electromagnetic source wave propagated in the waveguide.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
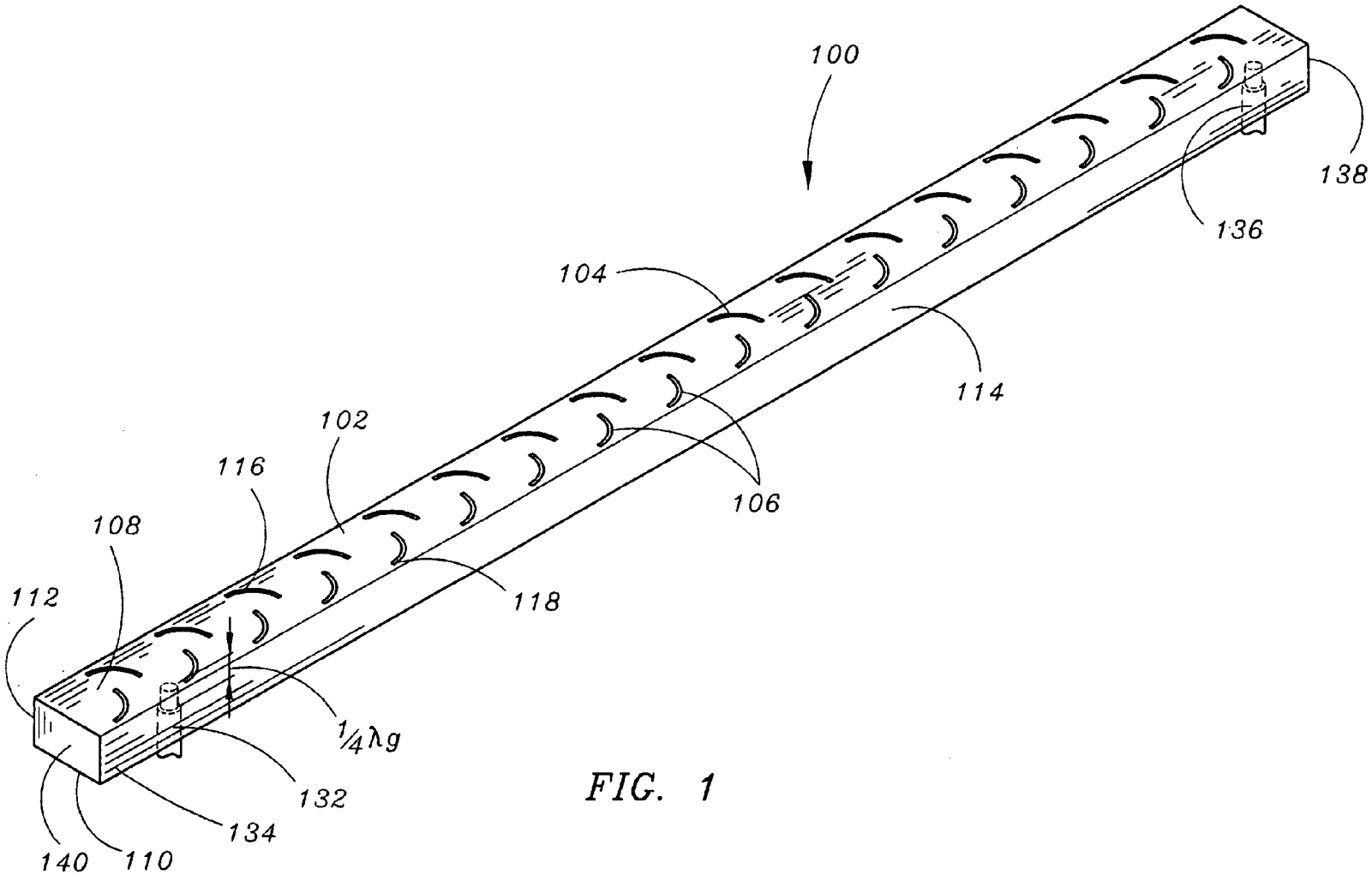
FIG. 1 is an isometric view illustrating a low-loss, low-profile dual-polarization slotted waveguide antenna in accordance with an exemplary embodiment of the present invention.

Reference will now be made in detail to the presently preferred embodiments of the invention, examples of which are illustrated in the accompanying drawings. It is to be appreciated that corresponding reference numbers refer to generally corresponding structures.

Referring now to FIGS. 1 through 16, low-loss, low-profile dual-polarization slotted waveguide antennas 100 in accordance with an exemplary embodiment of the present invention are described. The antennas 100 include one or more waveguides 102 having radiation apertures 104 comprised of arrays of waveguide slot pairs 106 which are configured for receiving and/or radiating a circularly polarized (CP) field. The waveguide slot pairs 106 are positioned for allowing the antenna 100 to receive and/or radiate both left-hand and right-hand circularly polarized fields (LHCP and RHCP), and for providing control of the sense of the circularly polarized (CP) field radiated by the antenna 100 by changing the direction of incidence of an electromagnetic source wave propagated in the waveguide 102. In this manner, the waveguide architecture provides an antenna having a low-profile and high-efficiency with intrinsically low manufacturing costs.

Figure 4:
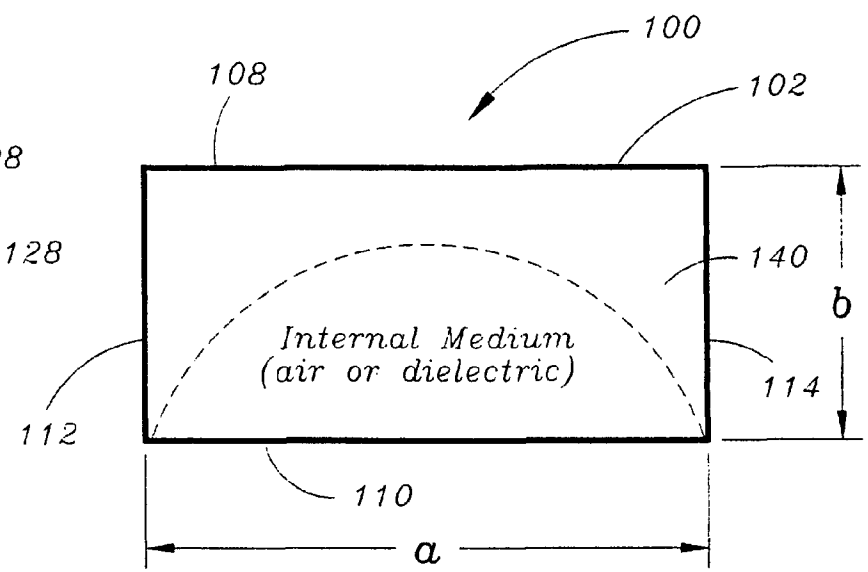
FIG. 4 is a cross-sectional end view of a waveguide of the antenna shown in FIG. 1.
Figure 7:
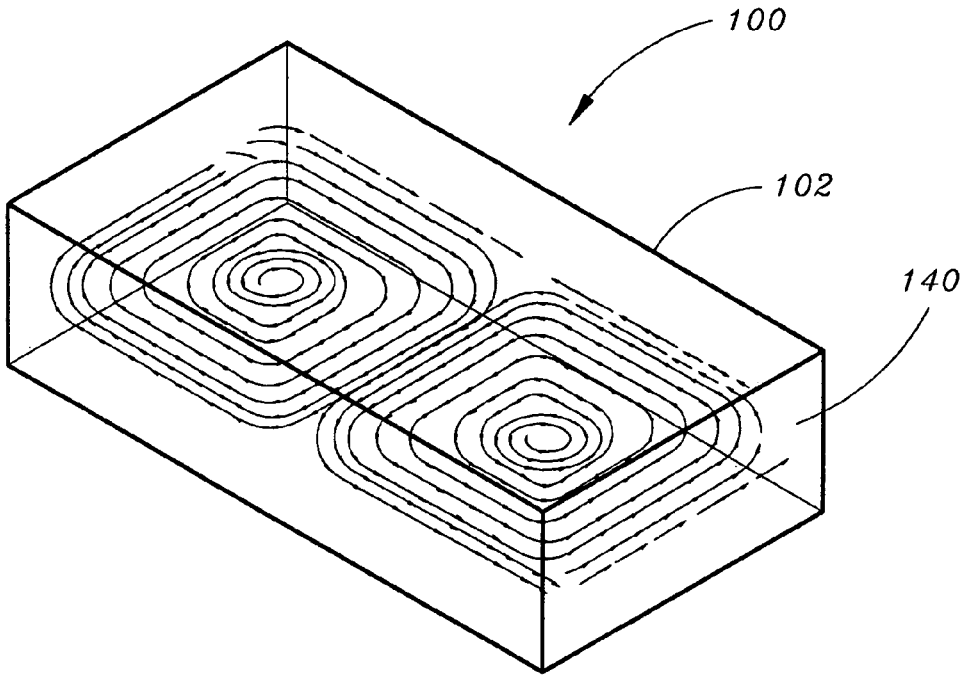
FIG. 7 is an isometric view illustrating a section of the waveguide of the antenna shown in FIG. 1, wherein a vector plot illustrates an exemplary electromagnetic field within the section of the waveguide.
Figure 8:
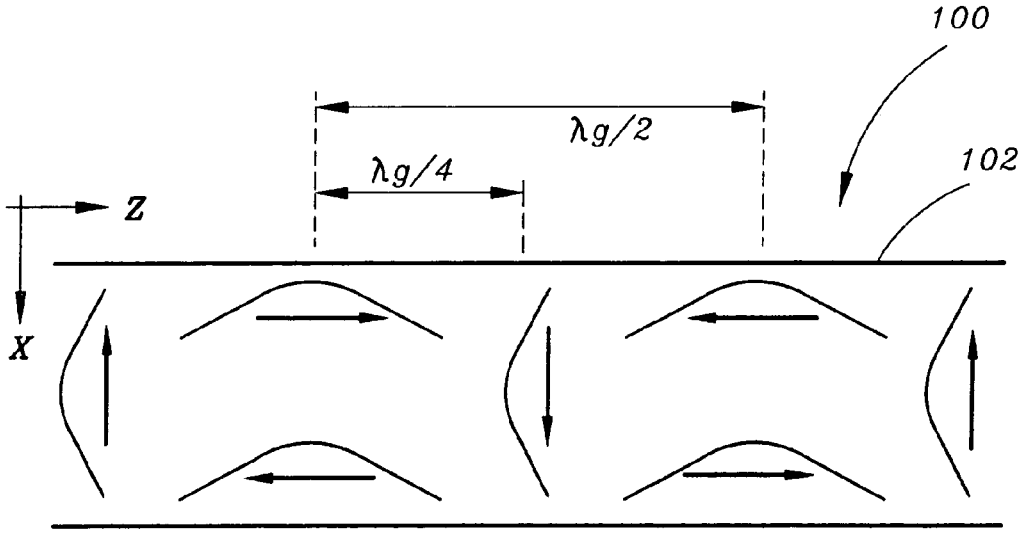
FIG. 8 is diagrammatic view illustrating the waveguide of the antenna shown in FIG. 1, further illustrating the directions of field polarization and the sinusoidal amplitude taper of each electromagnetic field within the waveguide.

In the embodiment illustrated in FIGS. 1 through 8, the antenna 100 comprises a single waveguide 102. As shown in FIGS. 1 and 4, the waveguide 102 is generally rectangular in cross-section having a front wall 108 and a back wall 110, which comprise the broad walls of the waveguide 102 having a width ("a"), and first and second side walls 112 & 114, which comprise the narrow walls of the waveguide 102 having a height ("b"). The dimensions of the walls 108, 110, 112 & 114 of the waveguide 102 (i.e., dimensions "a" and "b") are selected so that the waveguide 102 is sized to propagate electromagnetic fields having a characteristic guide wavelength ($\lambda_g$), determined from the equation:

$$\lambda_g = \frac{\lambda}{\sqrt{1+\left(\frac{\lambda}{\lambda_c}\right)^2}}$$

where $\lambda$ is the unbound wavelength of the radiated electromagnetic energy in the medium filling the waveguide (typically the wavelength in free space) and $\lambda_c$ is the cutoff wavelength for the waveguide mode of operation. Typically, the cutoff wavelength $\lambda_c$ is twice the width of a broad wall of the waveguide, i.e., width "a" in FIG. 5 ($\lambda_c$=2a). Additionally, the ($TE_{10}$) magnetic fields inside the waveguide 102 are defined, mathematically, by the following equations:

$$H_z = H_0\cos\left(\frac{\pi x}{a}\right)e^{-j\beta z}$$

$$H_x = j\frac{\beta a}{\pi}H_0\sin\left(\frac{\pi x}{a}\right)e^{-j\beta z}$$

where $H_0$ is a scalar magnitude term, $H_z$ is the longitudinal magnetic field, $H_x$ is the transverse magnetic field, $\beta$ is the guided wave number ($\beta=2*\pi/\lambda_g$), and j is the complex number ($j^2=-1$). FIGS. 7 and 8, illustrate the magnetic fields within the waveguide. In FIGS. 7 and 8, arrows indicate the direction of field polarization. Additionally, in FIG. 8, curves illustrate the sinusoidal amplitude taper of each field.

In accordance with the present invention, the radiation aperture 104 is formed in the front wall 108 of the waveguide 102. The radiation aperture 104 is comprised of a linear array of waveguide slot pairs 106 formed in the front wall 108. Each waveguide slot pair 106 includes a first waveguide slot 116 and a second waveguide slot 118 configured for receiving and/or radiating a circularly polarized (CP) field. For example, in the exemplary embodiment illustrated, the slots 116 & 118 of each waveguide slot pair 106 are generally crescent or arc-shaped having a first end 120 & 122 and a second end 124 & 126. In the specific embodiment illustrated, each of the crescent-shaped slots 116 & 118 comprises a sector or 90-degree arc of a circle having a radius ($r_s$) equal to one-fourth of the characteristic wavelength of the waveguide 102 ($r_s=\frac{1}{4}\lambda_g$) and a center (C) positioned along the longitudinal axis 128 of the front wall 108 of the waveguide 102. Each crescent-shaped slot 116 & 118 has a thickness ($t_s$) which is at least substantially uniform over the circumferential length ($l_s$) of the slot 116 & 118.

The crescent-shaped waveguide slots 116 & 118 of the present invention differ from X-shaped slots employed by conventional slotted waveguide antennas in that the crescent-shaped slots are designed to account for the intrinsic shape of the internal H-fields within the fundamental $TE_{10}$ rectangular waveguide mode. The $H_{trans}$ and $H_{long}$ fields (transverse and longitudinal magnetic fields, respectively), comprise the driving sources for the magnetic currents in the slot apertures which are, by application of the duality theorem, the source currents for the far-field radiation patterns. As shown in FIG. 7, the net internal magnetic fields in the fundamental $TE_{10}$ mode trace curved paths within the waveguide 102, thus, the slots are crescent or arc shaped. By extension, other slot shapes designed to utilize the intrinsic structure of the internal fields for alternate fundamental or hybrid waveguide modes in waveguides of various cross-sections such as, for example, ridged rectangular (FIG. 12), circular (FIG. 13), elliptical (FIG. 14), and the like, both with or without dielectric loading are contemplated and would not depart from the scope and intent of the present invention.

It is known that a slot cut in either the narrow or broad face of a rectangular waveguide represents a shunt and/or series impedance load to the waveguide. The slot dimensions of the waveguide antenna 100 of the present invention are selected so that the waveguide slots 116 & 118 present a resonant cancellation of the reactive component and only a substantially pure real load remains. Once the normalized conductances have been characterized, the placement of the slots may be adjusted until all conductances sum to a value of one (1), resulting in total energy transfer. In the event that a resonant slot is not realizable (e.g., the dimensions of the waveguide 102 are too small), inductive tuning posts may be used to cancel the reactive components presented by the waveguide slots 116 & 118 to the waveguide 102. The axial ratio (AR) of the radiated fields may also be considered in selecting the relative size and spacing of the waveguide slots 116 & 118. Due to heavy interaction in the near-field between the slots 116 & 118 of each waveguide slot pair 106, the slots 116 & 118 should be separated by appropriate amounts in both the longitudinal and transverse dimensions of the front wall 108 of the waveguide 102 (i.e., along longitudinal and transverse axes 128 & 130). This additional design consideration separates the CP waveguide slot radiators of the present invention from traditional linear slots in complexity.

Figure 3:
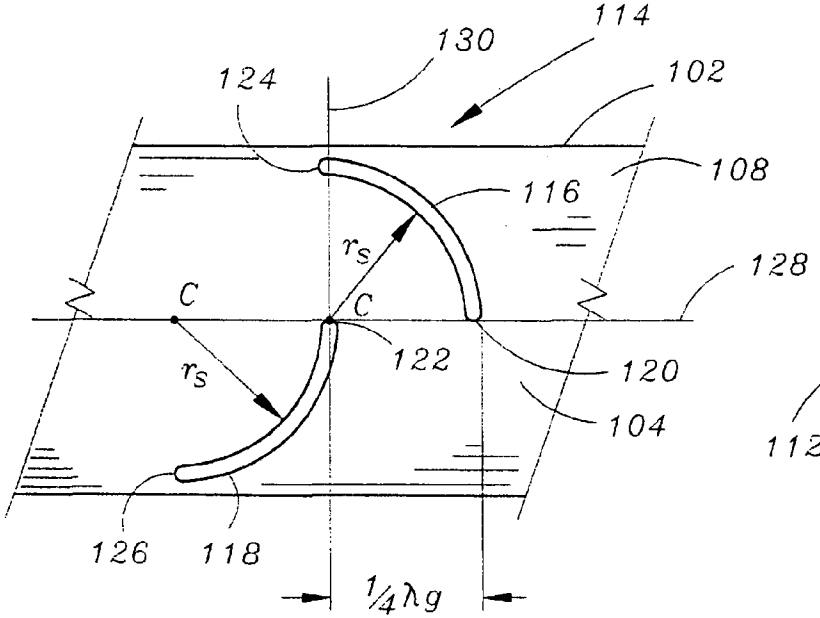
FIG. 3 is a partial top plan view of the antenna shown in FIGS. 1 and 2, further illustrating a single waveguide slot pair.
Figure 5:
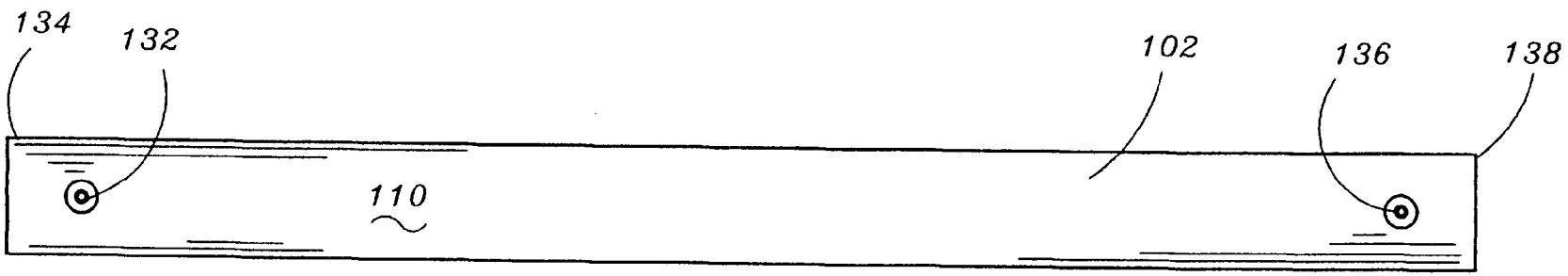
FIG. 5 is a bottom plan view of the antenna shown in FIG. 1, further illustrating the positioning of waveguide feeds or probes in the waveguide of the antenna.
Figure 6:
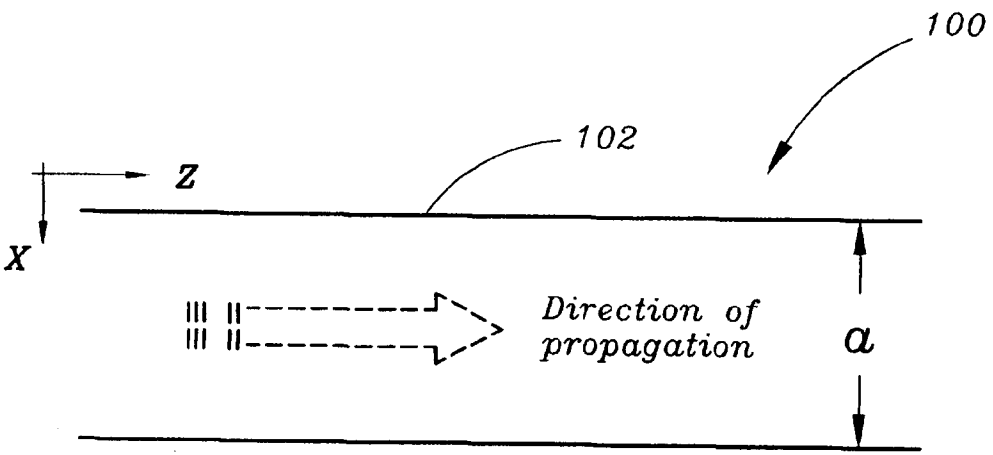
FIG. 6 is a diagrammatic view illustrating propagation of a wave within the waveguide illustrated in FIG. 1.

In exemplary embodiments, the waveguide slots 116 & 118 of each waveguide slot pair 106 are spaced a distance of at least approximately one-fourth of the characteristic wavelength ($\frac{1}{4}\lambda_g$) from each other. For example, as shown in FIG. 3, the first waveguide slot 116 of each waveguide slot pair 106 is staggered from the second waveguide slot 118 of the waveguide slot pair 106 along the longitudinal axis 128 of the front wall 108 of the waveguide 102. In this manner, the first end 120 of the first waveguide slot 116 is positioned a distance of one-fourth of the characteristic wavelength ($\frac{1}{4}\lambda_g$) from the first end 122 of the second waveguide slot 118 along the longitudinal axis 128. Additionally, the second end 124 of the first waveguide slot 116 is positioned a distance of one-fourth of the characteristic wavelength ($\frac{1}{4}\lambda_g$) from the first end 122 of the second waveguide slot 118 along a transverse axis 130 perpendicular to the longitudinal axis 128.

Figure 2:
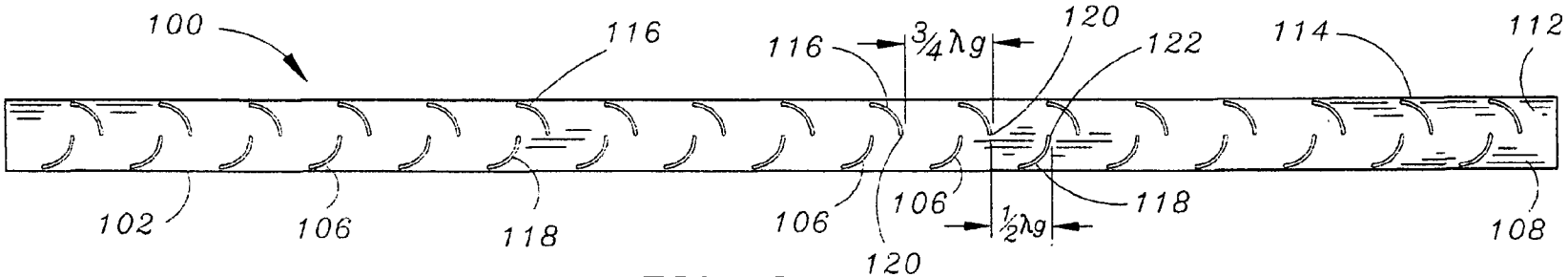
FIG. 2 is top plan view of the antenna shown in FIG. 1, further illustrating the radiation aperture of the antenna.

The waveguide slot pairs 106 may be spaced at an interval of between one-half of the characteristic guide wavelength ($\frac{1}{2}\lambda_g$) and one characteristic guide wavelength ($\lambda_g$) from each other. For example, in the specific embodiment illustrated, the waveguide slot pairs 106 are positioned at an interval of three-fourths of the characteristic guide wavelength ($\frac{3}{4}\lambda_g$) from adjacent waveguide slot pairs 106 along the longitudinal axis 128 so that any given point in a waveguide slot pair 106 is spaced a distance of three-fourths of the characteristic wavelength ($\frac{3}{4}\lambda_g$) from the corresponding point in an adjacent waveguide slot pair 106. In this manner, each waveguide slot pair 106 is spaced a distance of at least approximately one-half of the characteristic wavelength ($\frac{1}{2}\lambda_g$) from adjacent waveguide slot pairs 106. Thus, for example, as shown in FIG. 2, the first end 120 of the first waveguide slot 116 of a waveguide slot pair 106 is positioned a distance of three-fourths of the characteristic wavelength ($\frac{3}{4}\lambda_g$) from the first end 120 of the first waveguide slot 116 of an adjacent waveguide slot pair 106, while the first end 122 of the second waveguide slot 118 of the waveguide slot pair 106 is positioned a distance of one-half of the characteristic wavelength ($\frac{1}{2}\lambda_g$) from the first end 120 of the first waveguide slot 120 of the adjacent waveguide slot pair 106 and three-fourths of the characteristic wavelength ($\frac{3}{4}\lambda_g$) from the second end 122 of the second waveguide slot 118 of the adjacent waveguide slot pair 106.

The arrangement and positioning of the first and second waveguide slots 116 & 118 of the waveguide slot pairs allows the antenna 100 to receive and/or radiate both left-hand and right-hand circularly polarized fields (LHCP and RHCP). Further, this arrangement and positioning provides control of the sense of the circularly polarized (CP) radiated field by changing the direction of incidence of an electromagnetic source wave propagated in the waveguide 102. In this manner, the antenna 100 of the present invention provides dual-handed circular polarization (CP) using a single waveguide feeding structure. In the exemplary embodiment illustrated in FIG. 1, the waveguide antenna 100 includes a first waveguide feed or probe 132 positioned generally adjacent to a first end 134 of the waveguide 102 and a second coaxial waveguide feed or probe 136 positioned generally adjacent to a second end 138 of the waveguide 102 opposite the first end 134. In exemplary embodiments, the first waveguide feed 132 and the second waveguide feed 136 are positioned at a distance from the back wall of at least approximately one-fourth of the characteristic wavelength ($\frac{1}{4}\lambda_g$). When a right-hand circularly polarized (RHCP) radiated field is incident on the radiation aperture 104 of the waveguide 102, the first waveguide feed 132 is excited. Conversely, when a left-hand circularly polarized (LHCP) radiated field is incident on the radiation aperture 104 of the waveguide 102, the second waveguide feed 136 is excited. Similarly, where the antenna 100 functions as a radiator, the first or second waveguide feeds 132 & 136 may be excited for propagating a source wave in the waveguide 102 so that either a right-hand circularly polarized (RHCP) field or a left-hand circularly polarized (LHCP) field is radiated by the antenna 100. It will be appreciated that in embodiments of the invention, the antenna 100 may be provided with only one of the first waveguide feed 132 or the second waveguide feed 136, the other waveguide feed 132 or 136 being eliminated. In such embodiments, it is contemplated that the antenna 100 will radiate (or receive) either a left-hand circularly polarized (LHCP) field if the first waveguide feed 132 is removed and only the second waveguide feed 136 is provided or right-hand circularly polarized (RHCP) field if the second waveguide feed 136 is removed and only the first waveguide feed 132 is provided.

In exemplary embodiments, the waveguide antennas 100 of the present invention utilize dielectric loading for the waveguide feed manifold 108. In order to ensure maximum gain in the far-field radiation of a broadside antenna array, it is desirable that very small phase taper be present across the radiation aperture. Accordingly, it is desirable that the radiating elements (or slots) of the antenna be placed one full free-space wavelength apart. However, the wavelength of energy in an air-filled waveguide is greater than in free space. Consequently, when developing an antenna array with grating-lobe-free operation, element spacing should not exceed one free-space wavelength. Thus, in the exemplary embodiments illustrated, the waveguides 102 of the antennas 100 of the present invention may be dielectrically loaded by filling or at least partially filling the waveguide manifold 108 with dielectric material 140 (FIG. 4) to decrease the internal wavelength of the waveguide 102 so that the wavelength matches the slot-to-slot spacing of the waveguide slots 116 & 118 of radiation aperture 104. Preferably, a low-loss dielectric material 140 is used so that feed losses are minimized.

In applications where an aperture phase-taper is desirable, the radiating elements of a waveguide antenna may be placed less than a characteristic guide wavelength apart. However, this arrangement results in a beam squinting situation, wherein the far field radiation pattern is no longer located directly orthogonal to the plane of the slot array, but canted at some angle toward the horizon. Moreover, the beam width is increased slightly. Accordingly, in embodiments adapted for such applications, the antenna 100 of the present invention may employ a waveguide 102 having an internal medium comprised of air, a gas, a vacuum, or the like, instead of a dielectric 140. Such embodiments of the waveguide antenna 100 may also be employed in applications involving traveling wave situations (where, for example, element or slot spacing is typically less than a guide wavelength ($\lambda_g$)) and resonant architectures.

Figure 9:
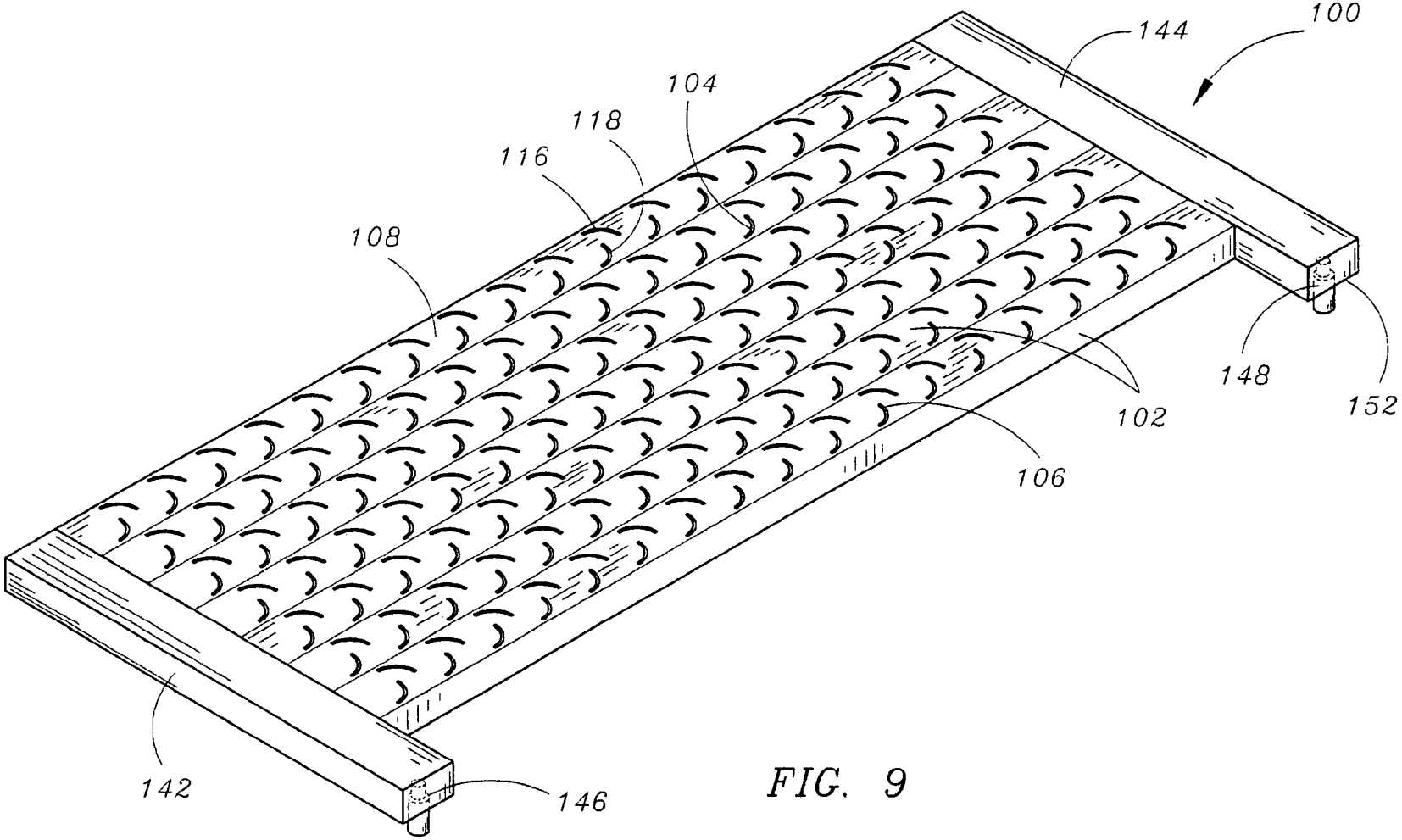
FIG. 9 is an isometric view illustrating a low-loss, low-profile dual-polarization slotted waveguide antenna in accordance with a second exemplary embodiment of the present invention, wherein a plurality of waveguides are combined to form a planar array.
Figure 10:
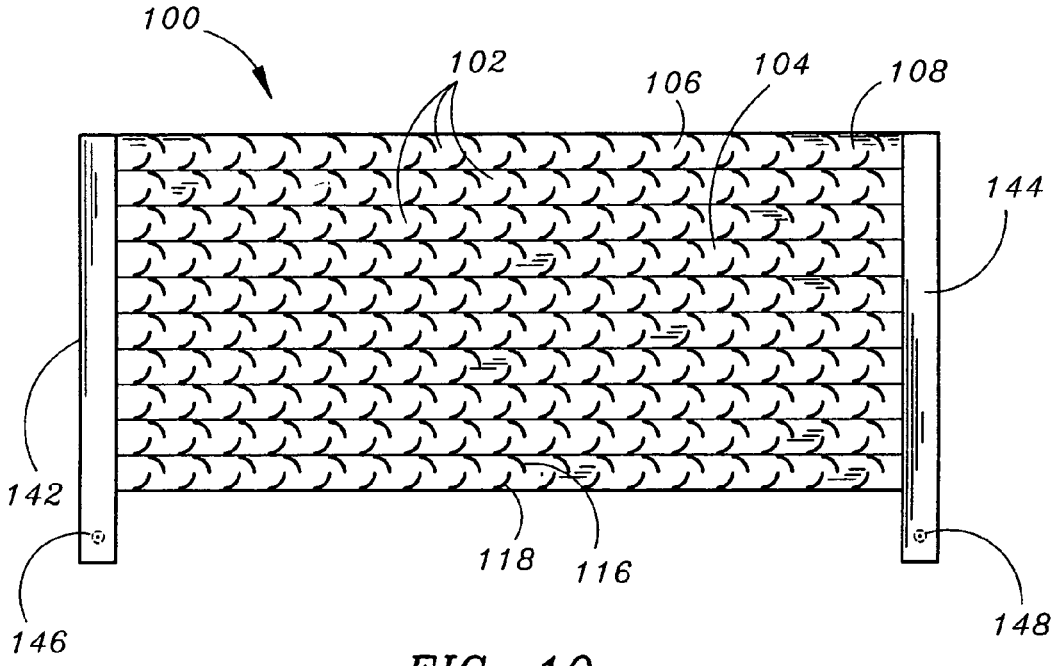
FIG. 10 is top plan view of the antenna shown in FIG. 9, further illustrating the radiation aperture of the antenna.
Figure 11:
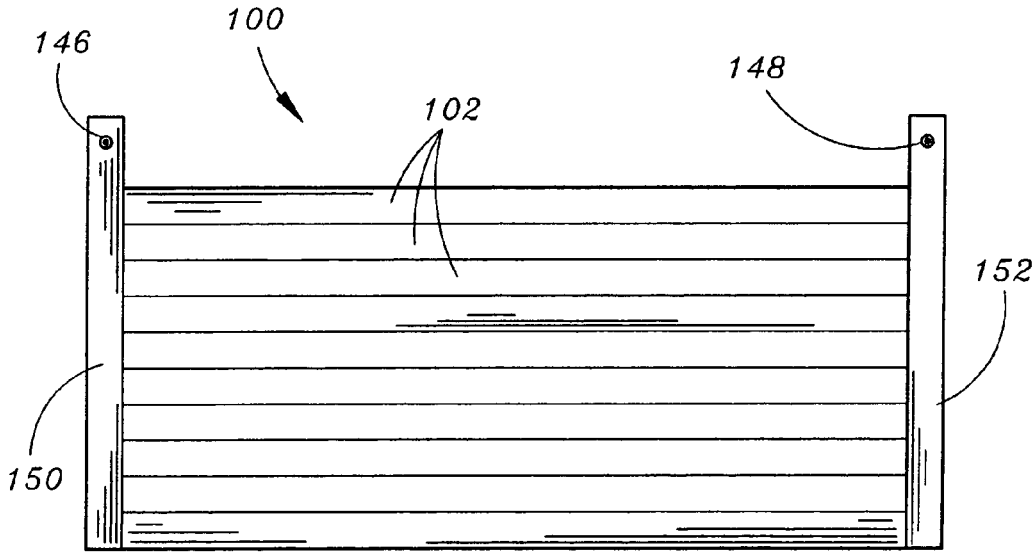
FIG. 11 is a bottom plan view of the antenna shown in FIG. 9, further illustrating positioning of waveguide feeds or probes in the waveguide of the antenna.
Figure 12:
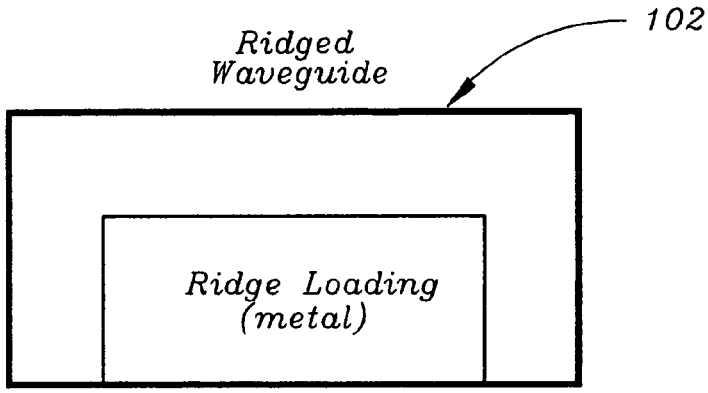
FIGS. 12, 13 and 14 are cross-sectional end views of alternate waveguides suitable for use as low-loss, low-profile dual-polarization slotted waveguide antennas in accordance with exemplary embodiments of the present invention.
Figure 13:
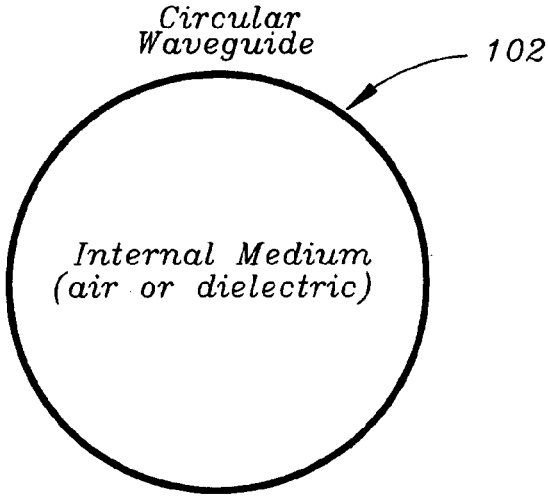
Figure 14:
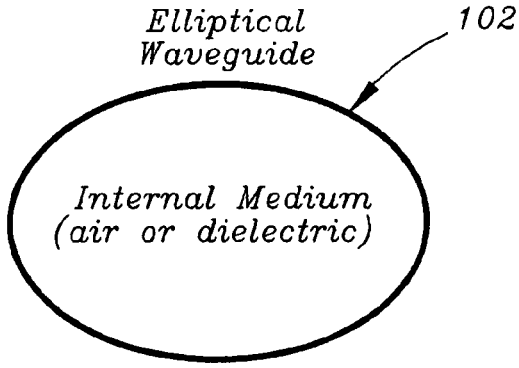

FIGS. 9 through 11 illustrate a low-loss, low-profile dual-polarization slotted waveguide antenna in accordance with a second exemplary embodiment of the present invention. In this embodiment, the antenna 100 comprises multiple waveguides 102 (an antenna having 10 waveguides is illustrated in FIGS. 10 and 11) juxtaposed against one another along the axis common to the narrow dimension of the waveguides 102 (i.e., the transverse axis 130 (FIG. 3)). The waveguides 102, when joined together, form a feed manifold 108 providing a radiation aperture 104 having planar array of waveguide slot pairs 106. The antenna 100 comprises a two-port feed structure employing feeding waveguides which are probe-coupled to a coaxial line. Thus, in the embodiment illustrated, the antenna 100 includes a first feeding waveguide 142 that is aperture-coupled to a first end of each of the plurality of waveguides 102 forming the waveguide manifold 108 and a second feeding waveguide 144 that is aperture-coupled to the second end of each of the plurality of waveguides 102 opposite the first feed waveguide 142. Preferably, first and second feeding waveguides 142 & 144 have apertures formed in their sidewalls which are sized and shaped to receive the ends of waveguides 102. A first coaxial waveguide feed 146 is positioned in the first feeding waveguide 142 and a second coaxial waveguide feed 148 is positioned in the second feeding waveguide 144. In exemplary embodiments, the coaxial waveguide feeds 146 & 148 are positioned at a distance from the bottom walls 150 & 152 of their respective feeding waveguides 142 & 144 of at least approximately one-fourth of the characteristic wavelength ($\frac{1}{4}\lambda_g$). When a right-hand circularly polarized (RHCP) radiated field is incident on the radiation aperture 104 of the waveguide manifold 108, the first waveguide feed 146 is excited. Conversely, when a left-hand circularly polarized (LHCP) radiated field is incident on the radiation aperture 104 of the waveguide manifold 108, the second waveguide feed 148 is excited. Similarly, where the antenna 100 functions as a radiator, the first or second waveguide feeds 146 & 148 may be excited for propagating a source wave in the waveguides 102 of the waveguide manifold 108 via the feeding waveguides 142 & 144 so that either a right-hand circularly polarized (RHCP) field or a left-hand circularly polarized (LHCP) field is radiated by the antenna 100.

Alternatively, a multi-port coaxial feed could be provided to the antenna 100 instead of the feeding waveguide structure illustrated. In such embodiments, separate coaxial feeds (not shown) would be provided adjacent to each end of each waveguide 102 of the waveguide manifold 108. The coaxial feeds positioned on one side of the waveguide manifold 108 or the other would be selectively excited when either a right-hand circularly polarized (RHCP) or left-hand circularly polarized (LHCP) radiated field is incident on the waveguides 102.

Figure 15:
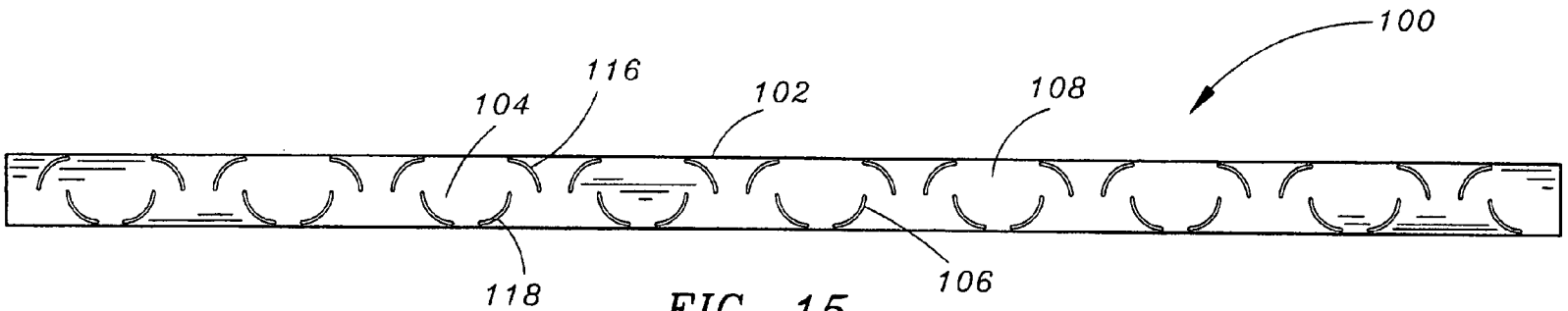
FIG. 15 is a top plan view illustrating a low-loss, low-profile dual-polarization slotted waveguide antenna in accordance with a third exemplary embodiment of the present invention, wherein alternate waveguide slots are reverse-phased.
Figure 16:
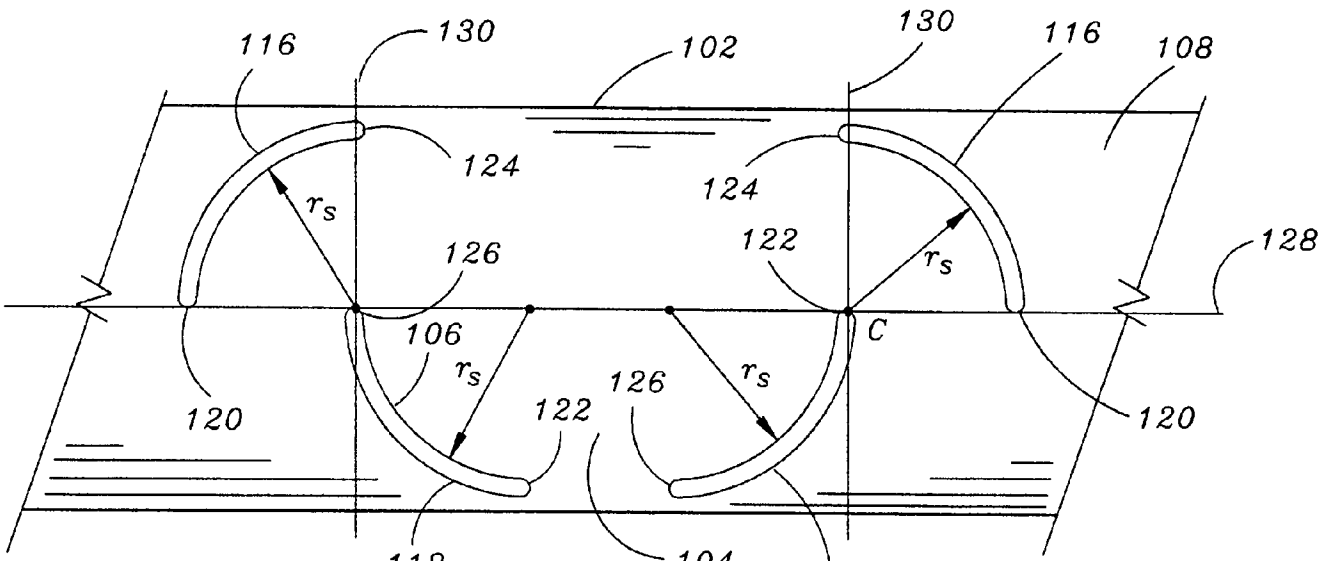
FIG. 16 is a partial top plan view of the antenna shown in FIG. 16, further illustrating a first waveguide slot pair having a first phase and a second waveguide slot pair having a second phase, wherein the first phase and the second phase are reverse-phased.

FIGS. 15 and 16 illustrate a low-loss, low-profile dual-polarization slotted waveguide antenna 100 in accordance with an alternative embodiment of the present invention. In this embodiment, alternate waveguide slot pairs 106 of the radiation aperture 104 are reverse-phased to allow for a 180 degree shift or rotation of any given waveguide slot 116 & 118 with respect to adjacent waveguide slots 116 & 118. In this manner, the need for dielectric loading of the waveguide feed manifold is eliminated, because element spacing is one half of the characteristic guide wavelength ($\frac{1}{2}\lambda_g$). Within a reasonable frequency range away from cutoff for the mode of operation in the waveguide 102, one half of a guide wavelength will be smaller than the array-lattice-limiting length of one free space wavelength.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An antenna, comprising:

a plurality of waveguides juxtaposed adjacent to each other, each of the plurality of waveguides having a characteristic wavelength;

a radiation aperture disposed in each of the plurality of waveguides, the radiation aperture including a first waveguide slot and a second waveguide slot formed therein, the first waveguide slot and the second waveguide slot being arranged in a waveguide slot pair;

a first feeding waveguide and a second feeding waveguide, the first feeding waveguide being coupled to a first end of each of the plurality of waveguides, and the second feeding waveguide being coupled to a second end of each of the plurality of waveguides opposite the first end;

a first coaxial waveguide feed positioned in the first feeding waveguide and a second coaxial waveguide feed positioned in the second feeding waveguide;

wherein the first waveguide slot and the second waveguide slot of the slot pair are configured for radiating or receiving a circularly polarized (CP) field and wherein the first feeding waveguide comprises a first wall and the second feeding waveguide comprises a second wall, and wherein the first coaxial waveguide feed is positioned at a distance from the first wall of at least approximately one-fourth of the characteristic wavelength and the second coaxial waveguide feed is positioned at a distance from the second wall of at least approximately one-fourth of the characteristic wavelength.

2. The antenna as claimed in claim 1, wherein the first waveguide slot and the second waveguide slot are generally crescent-shaped.

3. The antenna as claimed in claim 2, wherein the first waveguide slot is positioned at a distance from the second waveguide slot of at least approximately one-fourth of the characteristic wavelength.

4. The antenna as claimed in claim 1, wherein the first waveguide slot and the second waveguide slot are positioned for providing control of the sense of the circularly polarized (CP) field radiated from the waveguide when the direction of incidence of an electromagnetic source wave propagated by the waveguide is changed.

5. The antenna as claimed in claim 1 wherein when a right-hand circularly polarized (CP) radiated field is incident on the radiation apertures the first waveguide feed is excited and when a left-hand circularly polarized (CP) radiated field is incident on the radiation apertures the second waveguide feed is excited.

6. The antenna as claimed in claim 1, wherein each of the plurality of waveguides includes a dielectric.

* * * * *